United States Patent [19]

Ealba et al.

[11] Patent Number: 5,058,703

[45] Date of Patent: Oct. 22, 1991

[54] AUTOMOTIVE EXHAUST NOISE ATTENUATOR

[75] Inventors: Robert H. Ealba, Grosse Pointe Farms, Mich.; Robert W. Paterson, Simsbury; Michael J. Werle, West Hartford, both of Conn.; Walter M. Presz, Jr., Wilbraham, Mass.

[73] Assignee: United Technologies Corporation, Hartford, Conn.

[21] Appl. No.: 289,866

[22] Filed: Dec. 27, 1988

Related U.S. Application Data

[63] Continuation-in-part of Ser. No. 124,325, Nov. 23, 1987, Ser. No. 132,395, Dec. 15, 1987, and Ser. No. 857,908, Apr. 30, 1986.

[51] Int. Cl.[5] ..... F01N 1/14

[52] U.S. Cl. ..... 181/228; 181/263; 60/317

[58] Field of Search ..... 181/227, 228, 262, 263, 181/249, 264, 270; 60/312, 317

[56] References Cited

U.S. PATENT DOCUMENTS

| | | | |
|---|---|---|---|
| 1,445,049 | 2/1923 | Stuart | 239/601 |
| 2,652,127 | 9/1953 | Johnston | 181/228 X |
| 2,800,291 | 7/1957 | Stephens | 244/200 |
| 2,858,853 | 11/1958 | Lyon | 181/228 X |
| 3,578,264 | 5/1971 | Kuethe | 181/220 X |
| 3,588,005 | 6/1971 | Rethorst | 244/200 |
| 3,635,308 | 1/1972 | Millman | 181/220 |
| 3,645,357 | 2/1972 | Cassel | 181/227 |
| 3,696,617 | 10/1972 | Ellis | 181/220 X |
| 3,741,285 | 6/1973 | Kuethe | 165/1 |
| 3,776,363 | 12/1973 | Kuethe | 181/213 |
| 3,857,458 | 12/1974 | Ohtani et al. | 181/262 |
| 4,117,671 | 10/1978 | Neal et al. | 60/262 |
| 4,455,045 | 6/1984 | Wheeler | 296/185 |

OTHER PUBLICATIONS

AIAA-86-1614, "Forced Mixer Lobes in Ejector Designs", by W. Presz, Jr., and R. Gousy, dated Jun. 16-18, 1986.

AIAA-87-1867, "Lobed Nozzle Afterbody Research", by William D. Russell, dated Jun. 29-Jul. 2, 1987.

AIAA-87-0610, "Flow Structure in a Periodic Axial Vortex Array", by M. J. Werle and R. W. Paterson, dated Jan. 12-15, 1987.

AIAA-87-1837, "Short Efficient Ejector Systems", by W. Presz, Jr., and R. F. Blinn, dated Jun. 29-Jul. 2, 1987.

*Primary Examiner*—Brian W. Brown

*Attorney, Agent, or Firm*—Stephen E. Revis

[57] ABSTRACT

To reduce noise, an automotive exhaust tailpipe has a convoluted surface at or near its outlet to generate pairs of counterrotating axial vortices within the exhaust gases just before or just as the gases exit the tailpipe. The convoluted surface may be the internal surface of the tailpipe, or a thin-walled convoluted member may be disposed within the tailpipe near its outlet end.

24 Claims, 4 Drawing Sheets

FIG. 8
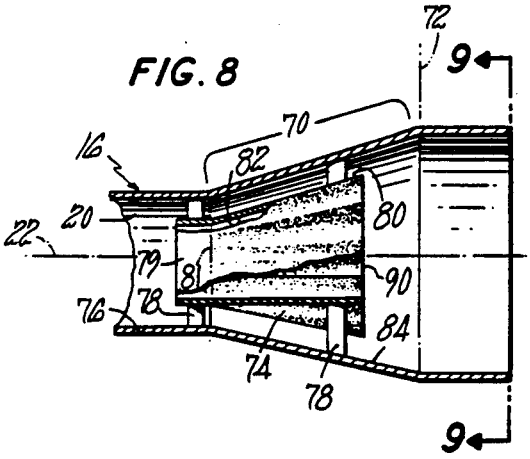
FIG. 9
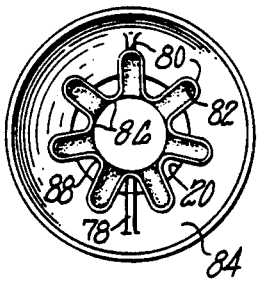
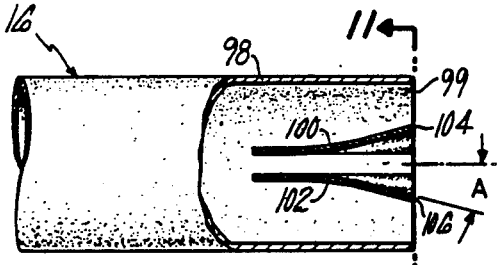
FIG. 10
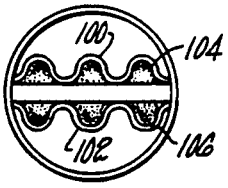
FIG. 11
FIG. 12
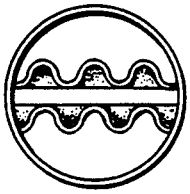
FIG. 13
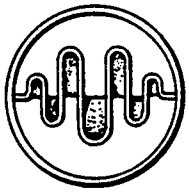
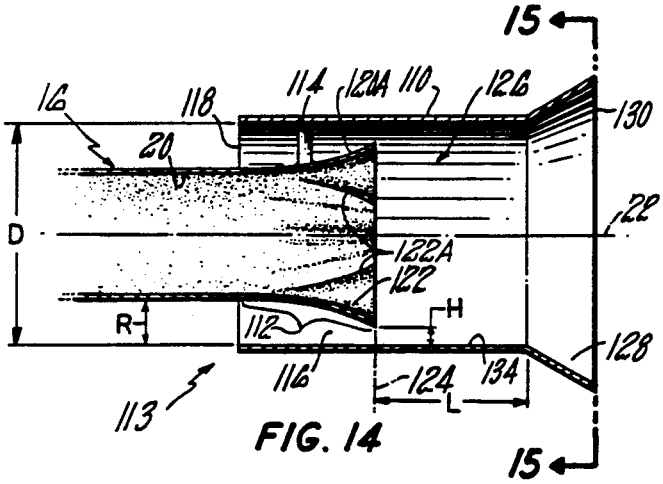
FIG. 14
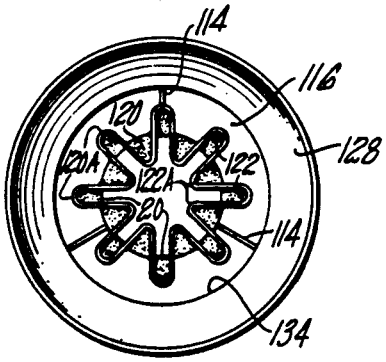
FIG. 15

AUTOMOTIVE EXHAUST NOISE ATTENUATOR

CROSS REFERENCE TO RELATED APPLICATIONS

This application is a Continuation-in-Part of U.S. Ser. No. 124,325, titled "Diffuser", by inventors Walter M. Presz, Jr., Robert W. Paterson, Michael J. Werle, and Robert H. Ealba, filed on Nov. 23, 1987; U.S. Ser. No. 132,395, titled "Diffuser with Convoluted Vortex Generator", by inventors Walter M. Presz, Jr., Robert W. Paterson and Michael J. Werle, filed on Dec. 15, 1987; and U.S. Ser. No. 857,908, titled "Fluid Dynamic Pump" by inventors Walter M. Presz, Jr., Robert W. Paterson, and Michael J. Werle, filed on Apr. 30, 1986.

TECHNICAL FIELD

This invention relates to automotive exhaust system tailpipes, and more particularly to apparatus for reducing noise emanating therefrom.

BACKGROUND ART

Automotive mufflers are well known for their ability to reduce noise generated by automotive internal combustion engines; however, in addition to the type of noise reduced by mufflers, there is noise emanating from the tailpipe which is generated downstream of the muffler. The cause of such noise has not heretofore been fully understood; and efforts to reduce such noise in a cost effective manner without creating engine performance deterioration have not been successful.

Diffusers have sometimes been useful for reducing noise by reducing fluid exit velocity. *Webster's New Collegiate Dictionary* (1981) defines diffusers as "a device for reducing the velocity and increasing the static pressure of a fluid passing through a system". As hereinafter used in this specification and appended claims, "diffuser" shall mean a fluid carrying passage which has an inlet cross-sectional flow area less than its outlet cross-sectional flow area, and which decreases the velocity of the fluid in the principal flow direction and increases its static pressure.

If the walls of the diffuser are too steep relative to the principal flow direction, streamwise, two-dimensional boundary layer separation may occur. Streamwise, two-dimensional boundary layer separation, as used in this specification and appended claims, means the breaking loose of the bulk fluid from the surface of a body, resulting in flow near the wall moving in a direction opposite the bulk fluid flow direction. Such separation results in high losses, low pressure recovery, and lower velocity reduction. When this happens the diffuser is said to have stalled. Stall occurs in diffusers when the momentum in the boundary layer cannot overcome the increase in pressure as it travels downstream along the wall, at which point the flow velocity near the wall actually reverses direction. From that point on the boundary layer cannot stay attached to the wall and a separation region downstream thereof is created.

To prevent stall a diffuser may have to be made longer so as to decrease the required diffusion angle; however, a longer diffusion length may not be acceptable in certain applications due to space or weight limitations, for example, and will not solve the problem in all circumstances. It is, therefore, highly desirable to be able to diffuse more rapidly (i.e., in a shorter distance) without stall or, conversely, to be able to diffuse to a greater cross-sectional flow area for a given diffuser length than is presently possible with diffusers of the prior art.

The automotive industry has experimented with diffusers to reduce tailpipe noise, but has not been totally successful. Specifically, diffusers have been added to the outlet end of a conventional cylindrical tailpipe, with a perforated plate disposed downstream of the diffuser, transverse to the exhaust flow direction. Such diffusers have been of the conventional conical variety, transitioning the tailpipe from one diameter to another larger diameter in gradual fashion; and they have been of the "dump" diffuser variety, which provides a step change in the tailpipe cross-sectional area. While these diffuser/perforated plate combinations have sometimes proved effective in reducing noise, the back pressure created by the perforated plate and by diffuser stall has been unacceptable; therefore, these configurations have not been widely adopted for production.

It is well known in the gas turbine engine art to use a convoluted exhaust nozzle to reduce jet noise, as shown and described in U.S. Pat. Nos. 3,635,308; 4,117,671 and 3,696,617, for example. The device described in the '617 patent uses a convoluted ejector configuration to draw ambient air into the exhaust nozzle to mix with core engine exhaust gases. Such convoluted gas turbine engine exhaust nozzles have not been used on automotive exhaust systems despite the fact that such technology has been in the public domain for at least twenty years. This may be due to the fact that aircraft gas turbine engines and automotive exhaust systems are in non-analogous fields.

DISCLOSURE OF THE INVENTION

According to the present invention, a convoluted, vortex generating surface is disposed within an automotive exhaust system tailpipe, near its outlet.

The convoluted surface may be a portion of the internal flow surface of the tailpipe or may be the surface of one or more convoluted plates disposed within the tailpipe. In either case, the convolutions are formed by a plurality of adjoining, alternating, U-shaped lobes and troughs extending in a downstream direction, with the troughs increasing gradually in depth toward their outlets from zero at their upstream or inlet ends. Each trough generates a pair of counterrotating axial vortices.

According to one embodiment of the present invention, a convoluted diffuser is disposed at the outlet of an automotive tailpipe to reduce noise by reducing the gas velocity inside the tailpipe with minimal flow losses, and by generating vortices downstream of the tailpipe to mix the exhaust gases and ambient air. The diffuser has a convoluted wall comprising a plurality of downstream extending, adjacent troughs and lobes. The troughs increase in depth toward the diffuser outlet and permit a greater amount of diffusion in a shorter distance. Even more importantly, the flow is significantly more uniform across the flow path at the outlet of the diffuser. Therefore, peak velocities are lower, and noise is lower. The tailpipe outlet is wave shaped as a result of the convolutions. The convolutions generate a plurality of adjacent, counterrotating axial vortices downstream of the tailpipe outlet, which rapidly mix the exhaust gases with ambient air to quickly reduce the axial velocity of the gases once they have exited the tailpipe. This further reduces noise. Convoluted diffusers of the type contemplated herein are shown and described in commonly owned patent application U.S. Ser. No. 124,325 filed on Nov. 23, 1987 by Walter M. Presz, Jr. et al.

In another embodiment, the tailpipe extends a short distance beyond the convoluted diffuser outlet and has a step change increase in cross-sectional flow area at the diffuser outlet. The axial vortices generated by the troughs and lobes within the tailpipe allow the sudden increase in cross-sectional flow area to occur with reduced flow losses. The tailpipe extension downstream of the convolutions provides a mixing volume within the tailpipe in which the gases can attain a more uniform velocity profile before exiting the tailpipe Peak gas exit velocity, and thereby noise, is reduced with minimal adverse impact on engine performance.

In other embodiments, vortex-generating convoluted plates like those shown and described in commonly owned patent application U.S. Ser. No. 132,395 titled "Diffuser with Convoluted Vortex Generator", by inventors Walter M. Presz, Jr., Robert W. Paterson and Michael J. Werle, filed on Dec. 15, 1987 and commonly owned U.S. Pat. No. 4,776,535 titled "Convoluted Plate to Reduce Base Drag", by inventors Walter M. Presz, Jr., Robert W. Paterson and Michael J. Werle, (both of which are incorporated herein by reference), are disposed inside the tailpipe, near the outlet. In one embodiment the plates simply generate low loss counterrotating axial vortices within the exhaust gases as they exit the tailpipe. In another embodiment the plates are disposed adjacent the smooth conical wall of a diffuser portion of the tailpipe and promote low loss, rapid diffusion of the gases within the tailpipe as well as generating counterrotating axial vortices.

Since both diffusion and vortex generation contribute to the noise reduction, one might be present without the other and still provide significant noise reduction. Thus convoluted, vortex generating tailpipe outlets which do not diffuse the flow within the tailpipe are also contemplated within the scope of this invention.

The foregoing and other features and advantages of the present invention will become more apparent from the following description and accompanying drawing.

BRIEF DESCRIPTION OF THE DRAWINGS

FIG. 8 is a view similar to that of FIG. 2, showing another embodiment of the present invention.

FIG. 9 is a view taken along the line 9—9 of FIG. 8.

FIG. 10 is a view similar to that of FIG. 2 showing yet another embodiment of the present invention.

FIG. 11 is a view taken along the line 11—11 of FIG. 10.

FIGS. 12 and 13 are views similar to FIG. 11 illustrating alternate configurations for the embodiment shown in FIGS. 10 and 11.

FIG. 14 is a view similar to that of FIG. 2 showing a further embodiment of the present invention.

FIG. 15 is a view taken along the line 15—15 of FIG. 14.

BEST MODE FOR CARRYING OUT THE INVENTION

Figure 1:
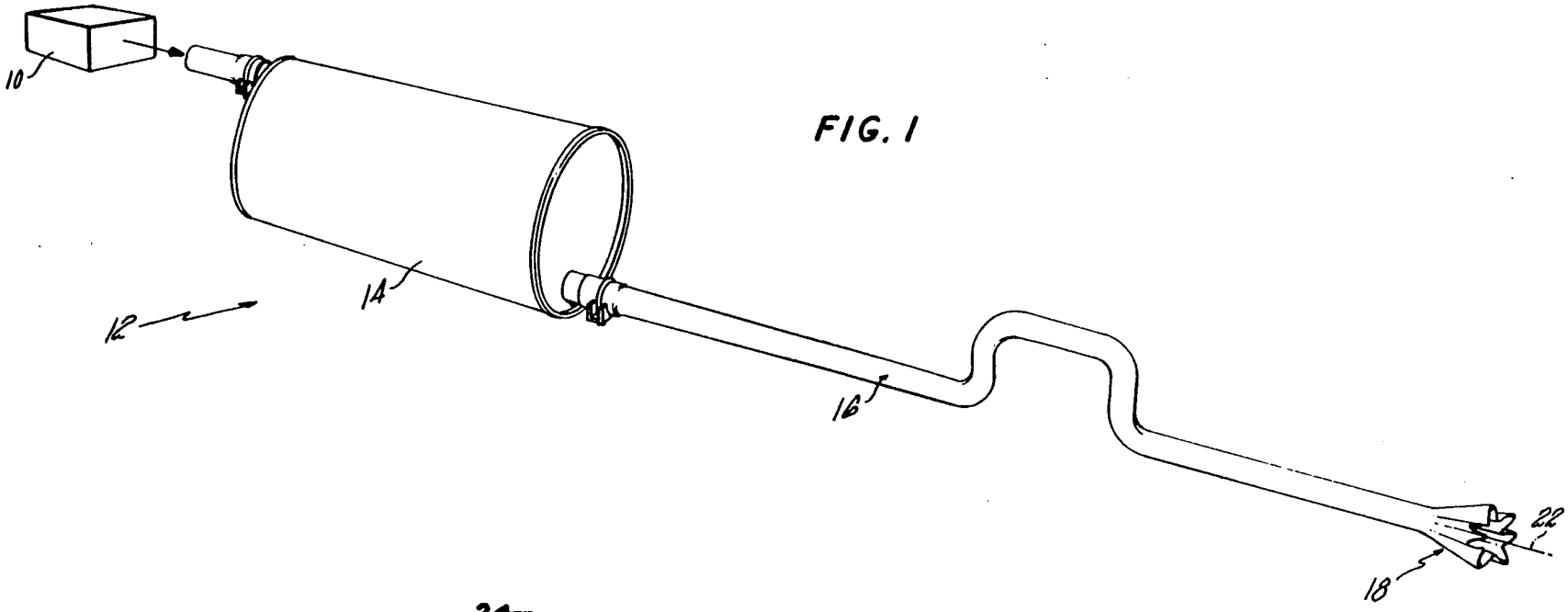
FIG. 1 is a simplified illustrative view, partially schematic, showing an automotive exhaust system incorporating the features of the present invention.

Referring to FIG. 1, an internal combustion engine for an automobile, truck, bus or other similar type of automotive application is represented by the block 10 The exhaust system of the engine 10 is generally designated by the reference numeral 12. Only the muffler 14 and tailpipe 16 of the exhaust system are shown in the drawing for purposes of simplicity, although a typical automotive exhaust system will have other components, such as an exhaust manifold and a catalytic converter.

Figure 3:
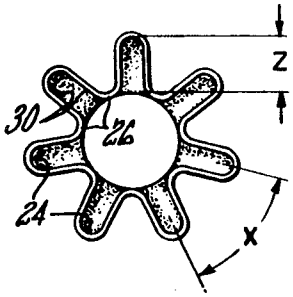
FIG. 3 is a view taken along the line 3—3 of FIG. 2.
Figure 2:
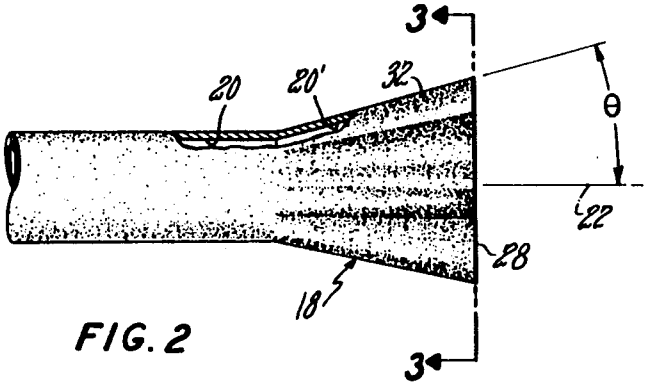
FIG. 2 is an enlarged view, partly broken away, of the outlet end portion of the exhaust system of FIG. 1 showing features of the present invention in more detail.

With reference to the enlarged views of FIGS. 2 and 3, the tailpipe 16 has an internal flow path defining surface 20 and a central flow axis designated by the reference numeral 22. The tailpipe 16 is generally circular in cross section along its length, except for the tailpipe noise reducer generally designated by the numeral 18.

In this exemplary embodiment the noise reducer 18 is a convoluted diffuser at the end of the tailpipe 16. This diffuser is generally of the type described in the herein above-referenced commonly owned U.S. patent application Ser. No. 124,325. More specifically, the diffuser is axisymmetric and coaxial with the immediately upstream portion of the tailpipe, which is cylindrical in this instance. The wall of the diffuser is convoluted. Thus, the internal surface 20' is an undulating surface of circumferentially spaced apart adjoining troughs and lobes 24, 26, respectively. Each trough and lobe initiates at, and preferably blends smoothly with, the downstream end of the cylindrical portion of the tailpipe. The peaks of the lobes 26 are coextensive with an imaginary extension of the cylindrical surface 20 of the tailpipe, and are parallel to the axis 22. The troughs and lobes gradually increase in depth and height, respectively, from zero to a maximum at the diffuser outlet 28, which is also the tailpipe outlet.

In this embodiment the sidewalls 30 of each trough in the internal surface 20' are parallel to each other. The trough and lobe contours and the angle $\theta$ that the floor of each trough forms with the axis 22 are selected such that the troughs 24 flow full, which means that no two-dimensional boundary layer separation occurs along the surface of the diffuser over the entire length of the troughs. The troughs and lobes in the internal surface 20' produce a more uniform greater diffusion of fluid across the duct than would otherwise be possible for a prior art diffuser of the same axial length and flow area increase, such as if the prior art diffuser were simply a segment of a cone or some other surface of revolution about the axis 22. In general, it is preferred that the troughs and lobes are basically "U"-shaped in cross section and blend smoothly with each other along their length to form a smoothly undulating diffuser surface and a smooth wave shape at the tailpipe outlet 28.

Although in this embodiment the troughs initiate at the diffuser inlet and extend to the diffuser outlet, this may not be required or desired in all cases. The diffuser flow surface could initiate as the surface of a cone, and the undulations could start at some point between the diffuser inlet and outlet, but upstream of where any two-dimensional boundary layer separation from the surface of the diffuser occurs.

The troughs and lobes in the diffuser flow surface permit more rapid diffusion of the exhaust gas than conventional diffusers, and do it without boundary layer separation. Additionally, and perhaps equally or even more importantly, each trough 24 of the convoluted surface 20' generates a pair of counterrotating, large-scale axial vortices downstream of the outlet 28. By "large-scale" it is meant that the vortices have a diameter which is on the order of the depth of the trough 24 at the outlet 28. By "axial vortices" it is meant that the vortices rotate each about their own respective axis which extends generally downstream, substantially in the direction of the axis 22. These vortices entrain surrounding ambient air thereby increasing the speed with which the exhaust gas mixes with the ambient air downstream of the outlet 28. As a result of this improved mixing action, the average velocity of the exhaust gas is more rapidly reduced, thereby diminishing tailpipe noise.

If X is the distance between adjacent troughs (i.e., "wave length") at the location of the maximum trough depth Z (usually at the diffuser outlet), the ratio of X to Z is preferably no greater than about 4.0 and no less than about 0.5. In general, if the maximum depth Z is too small and/or X is too large in relation thereto, stall (i.e., boundary layer separation) may be delayed but not eliminated. On the other hand, if Z is too great relative to X and/or the troughs are too narrow, viscous losses could negate some or all of the benefits of the invention. It should be noted, however, that for applications where the mixing benefits are more important than minimizing losses, X to Z ratios as high as 10 may provide such benefits and are recommended.

Further as regards the embodiment of FIGS. 1–3, the external surface 32 of the diffuser portion of the tailpipe 16 is also convoluted. More specifically, the troughs 24 on the inside surface define corresponding lobes on the external surface; and the lobes 26 on the inside surface define corresponding troughs in the external surface. A wave-shaped tailpipe outlet edge is thereby defined, which is coextensive with the trough outlets. When the vehicle is moving, ambient air flows over the lobes and within the troughs of the external surface at a velocity, relative to the tailpipe, which is the same as the speed of the vehicle. Each external trough reinforces the counterrotating large-scale axial vortices generated by the internal convoluted surface to further enhance the mixing of the exhaust gas with ambient air. Although it is preferable that both the internal and external convoluted surfaces produce vortices, the reinforcing of vortices by the external troughs and the prevention of boundary layer separation on the external surface is not critical to obtaining benefits from the present invention.

Figure 4:
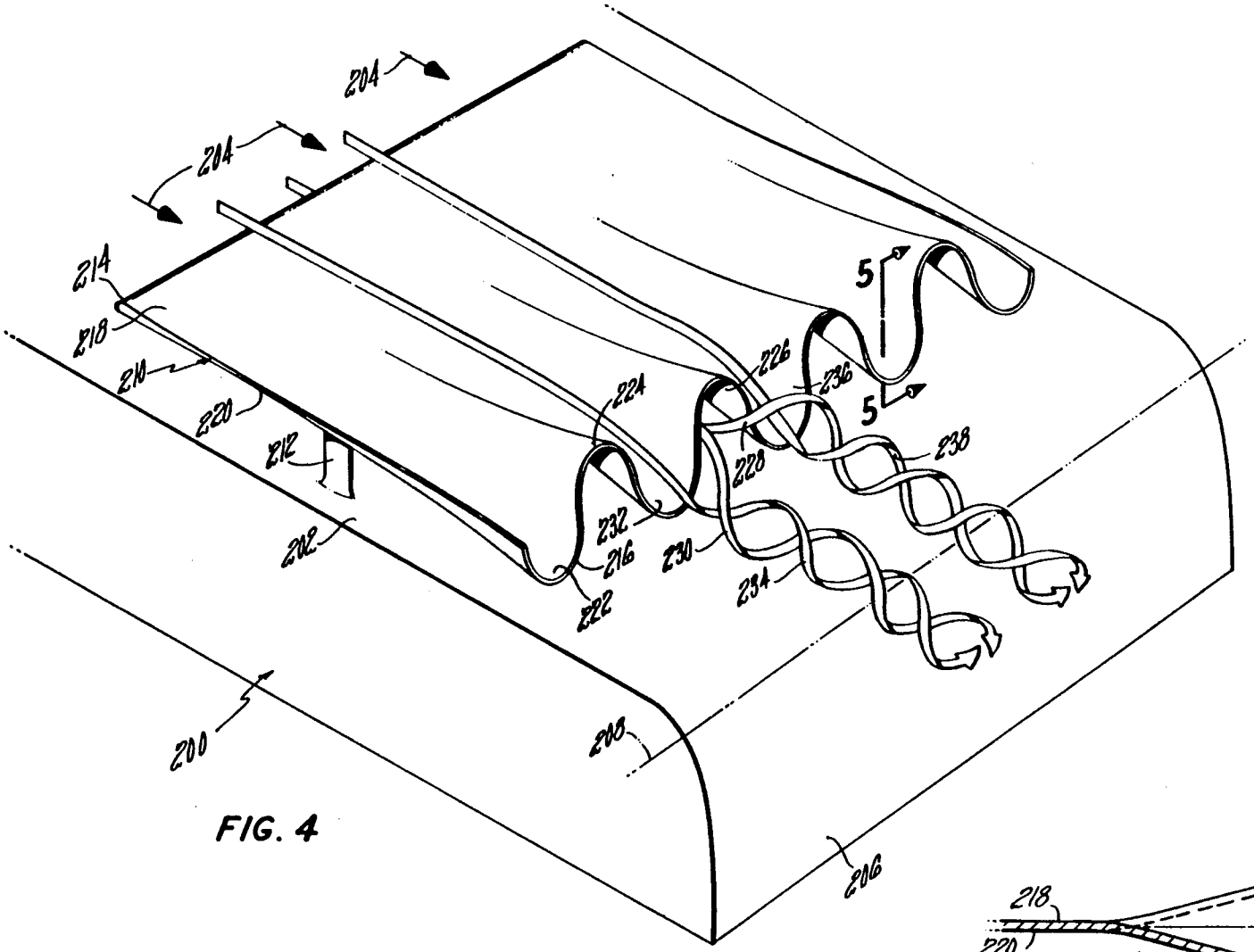
FIG. 4 is a figure reproduced from a related application, which illustrates certain aspects of the present invention.
Figure 5:
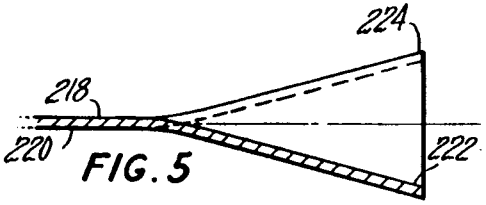
FIG. 5 is a sectional view taken along the line 5—5 of FIG. 4.

For purposes of describing a vortex-generating convoluted surface of the type contemplated herein, consider FIGS. 4 and 5. Except for the deletion of some reference characters, FIGS. 4 and 5 are reproductions of FIGS. 14 and 14A from commonly owned U.S. patent application Ser. No. 117,770 filed Nov. 5, 1987 titled "Convoluted Plate to Reduce Base Drag" by R. W. Paterson et al. As shown therein, an article 200 has a smooth, relatively flat upper surface 202 over which fluid flows in the generally downstream direction represented by the arrows 204. The article 200 has a blunt base or end surface 206. A convoluted wall member 210 is mounted on and spaced from the surface 202 by means of support members or standoffs 212, only one of which is shown in the drawing. The plate 210 has an upstream or leading edge 214, a downstream or trailing edge 216, an upper surface 218, and a lower surface 220. The plate 210 is for the purpose of generating vortices close to the surface 202 which energize the boundary layer on the surface 202 to delay separation from such surface beyond an imaginary line 208, thereby reducing base region drag on the article 200.

While the present invention is not concerned with reducing base drag, the plate 210 is analogous to the convoluted wall of the diffuser 18, which has fluid flowing on both sides thereof when the vehicle is moving. And vortices are generated by the diffuser 18 in the same manner as they are generated by the convoluted plate 210. With respect to the plate 210, a plurality of U-shaped troughs 222 and lobes 224 are formed in one surface of the plate. Adjacent troughs and lobes blend smoothly into each other forming an undulating or convoluted downstream portion of the plate, which terminates in a wave-shape at its trailing edge 216. In FIGS. 2 and 3, the external surface 32 corresponds to the surface 218 of FIG. 4; and the troughs and lobes in the external surface 32 are analogous to the troughs and lobes 222, 224, respectively. Similarly, the internal tailpipe surface 20 corresponds to the surface 220 of the plate 210; and the troughs 226 in the surface 220 are analogous to the troughs 24 in the surface 20'.

The vortices generated by the troughs and lobes on each side of the plate 210 are shown schematically in the drawing. For vortices to be generated, trough depth and lobe height must increase in the downstream direction. Preferably, trough depth and lobe height are zero at their upstream ends and are a maximum at the downstream edge 216; however, trough depth could reach its maximum upstream of the trough outlet and thereafter remain constant to the outlet.

One large scale vortex, having its axis in the bulk fluid flow direction, is generated off of each sidewall of each trough. Thus, the trough 226 generates a clockwise rotating vortex 228 from its right sidewall (as viewed in FIG. 4) and a counterclockwise rotating vortex 230 from its left sidewall. An adjacent trough 232 on the opposite side of the plate to the left of the trough 226 also generates a counterclockwise rotating vortex 234 from its right wall which combines with and reinforces the counterclockwise rotating vortex 230 to form what is essentially a single stronger vortex. Similarly, the left sidewall of the trough 236 generates a clockwise rotating vortex 238 which combines with the clockwise rotating vortex 228 from the troughs 226. The diffuser 18 generates vortices in the same manner.

For strong counterrotating vortices to be generated it is important that there be no two-dimensional streamwise boundary layer separation along the surfaces of the lobes and troughs. Trough and lobe contour and shape are selected with this in mind. In this regard, and with reference to FIG. 2, as previously mentioned, the angle $\theta$ formed between the axis 22 and the floor or bottom of each trough cannot be so steep as to result in boundary separation within the troughs. (Note, $\theta$ should not be confused with the effective half angle of a diffuser.) The maximum permissible angle 8 will depend, in part, upon the ratio of the cross-sectional flow area at the diffuser outlet to the cross-sectional flow area at the diffuser inlet. However, the convoluted design of the diffuser permits a greater outlet-to-inlet area ratio, without separation, for the same length conical diffuser. With the present invention, effective diffuser half angles as high as 20° or perhaps even 30° may be possible. With conical diffusers half angles must normally be maintained below 10°.

The angle $\theta$ should also not be too shallow. Very small angles $\theta$ will not result in the generation of very strong vortices. Also, the peak-to-peak wave length X, measured along the circumference of a circle tangent to the radially outer most edges of the internal troughs 24 at the outlet 28, should be no less than about half and no more than about four times the wave amplitude Z, which is the depth of the troughs 24 at the outlet 28. This is more likely to assure the formation of sufficiently strong vortices without inducing excessive pressure losses. It is also preferred, but not required, that the sidewalls of the inside troughs 24 are parallel to each other.

As one possible example of a convoluted diffuser for an automotive exhaust system of the type shown in FIGS. 1 thru 3, assume the tailpipe upstream of the diffuser is cylindrical and has an inside radius of 1.0 inch. The diffuser has twelve lobes and is 5.0 inches long. $\theta$ is about 30°; Z=3.0 inches; and X=1.3 inches. The opposed sidewalls of each internal trough are parallel to each other and spaced 0.65 inch apart.

As discussed above, noise is reduced in two ways by the embodiment of the invention shown in FIGS. 1 thru 3. The first is using the convolutions to do a better job of diffusing the flow before it exits the tailpipe. Diffusion not only occurs with lower losses, but the fluid spreads more rapidly and uniformly into the increasing cross-sectional flow area. The second way noise is reduced is by the action of the counter rotating vortices generated by the convolutions. If the trough outlets and tailpipe outlet are coextensive, the vortices help mix the ambient air with the exhaust fluid to more rapidly reduce exit velocities, and thus noise. If the tailpipe continues downstream of the trough outlet (as in the embodiment of FIG. 6, for example, to be hereinbelow described), the vortices more rapidly cause the exhaust fluid to spread uniformly across the flow path cross-sectional flow area.

These two noise reducing mechanisms are not necessarily dependent upon each other. Thus, the convoluted portion of the tailpipe need not diffuse, as long as the counter rotating axial vortices are generated downstream. As a matter of fact it may be preferable not to diffuse very much or not at all along the axial length of the convolutions, as this will allow steeper trough angles without two dimensional streamwise boundary layer separation. The result may be the generation of even stronger vortices, which may be used within the tailpipe to diffuse rapidly and efficiently immediately downstream of the convolutions, or which create more rapid mixing out of the fluid with ambient air downstream of the tailpipe outlet.

Figure 6:
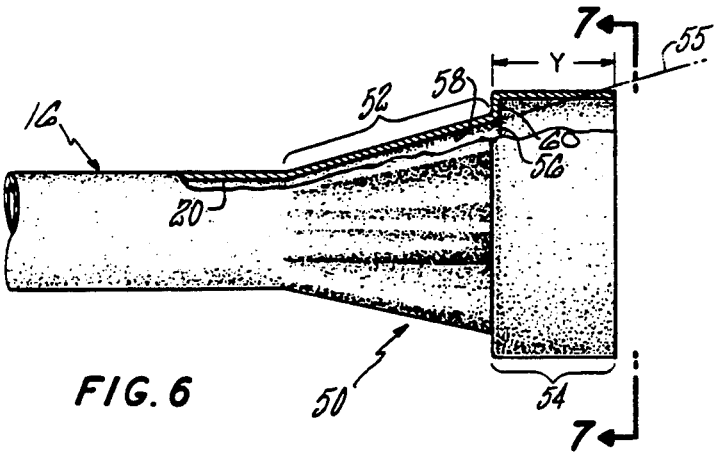
FIG. 6 and 6A are views similar to FIG. 2, but showing alternate embodiments of the present invention.
Figure 7:
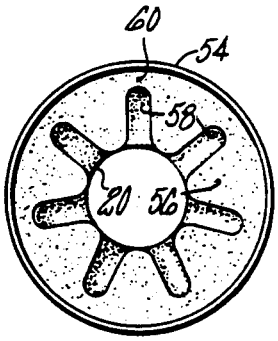
FIG. 7 and 7A are views taken along the line 7—7 of FIG. 6 and 7A—7A of FIG. 6A, respectively.

Another embodiment of the present invention is shown in FIGS. 6 and 7. In FIGS. 6 and 7 the tailpipe is still referred to by the reference numeral 16, and its internal flow path defining surface by the reference numeral 20. The noise reducer 18 of FIG. 1 has been replaced by the noise reducer 50. The noise reducer 50 comprises a convoluted diffuser 52 (which may be of the same type as the convoluted diffuser of FIG. 1-3) plus a cylindrical extension 54 of the tailpipe 16, coaxial with the upstream cylindrical portion of the tailpipe and disposed immediately downstream of the outlet plane 56 of the troughs 58. The extension 54 defines a mixing region for development of the vortices. Although not required, it is preferred that the internal diameter of the tailpipe extension 54 be greater than the diameter of a circle which circumscribes and is tangent to the troughs 58. Thus, the wall 20 extends radially outwardly from the troughs 58 in the plane 56, as shown at 60. The step at 60 provides additional space for vortex development such that the vortices generated by the troughs 58 do not immediately strike the tailpipe wall and dissipate, which could reduce their effectiveness. The step at 60 also provides for a further and sudden diffusion and velocity reduction without excessive tailpipe lengthening. The vortices generated by the convolutions reduce the losses associated with such a discontinuity in the flow path. The step should be small enough, in relation to the length Y of the extension 54, that an imaginary line 55 extending along the floor of the trough intersects the wall of the extension 54.

Figure 6A:
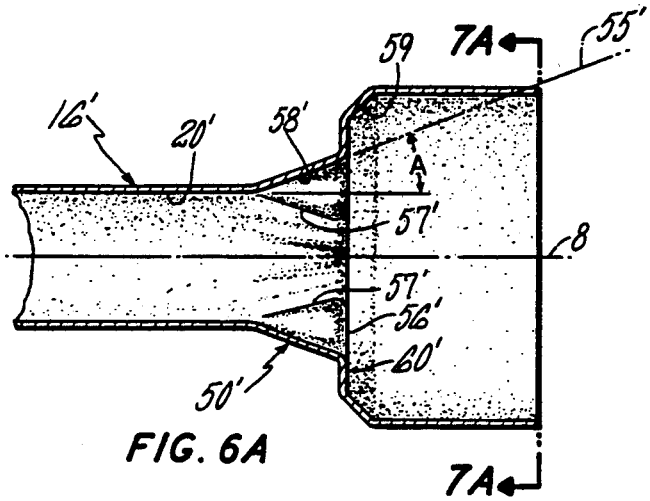
Figure 7A:
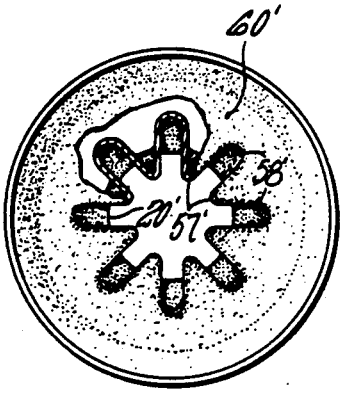

Another embodiment of the present invention is shown in FIGS. 6A and 7A. This embodiment is a variation of the embodiment of FIGS. 6 and 7. Elements of FIGS. 6A and 7A which are analogous to elements of FIGS. 6 and 7 have been given the same, but primed reference numerals. In this embodiment the lobes 57' slope toward the central flow axis 8 of the tailpipe, and the cross-sectional flow area of the tailpipe 16' remains substantially constant over the axial length of the troughs. At the trough outlet plane 56' the wall 20' extends radially outwardly as shown at 60' to result in step-wise diffusion of the flow in that plane. Immediately, thereafter, as at 59, the flow path gradually increases in cross-sectional area as a conical diffuser and then becomes cylindrical once again at a larger, final diameter.

By not diffusing through the convolutions or troughs 58', steeper trough angles A may be used without the occurrence of two-dimensional boundary layer separation. In this manner stronger vortices can be generated; and the resulting diffusion downstream of the troughs may be even more rapid and efficient than if diffusion took place over the length of the troughs.

In the embodiment of FIGS. 8 and 9 the tailpipe is still identified by the reference numeral 16; and its internal surface is still identified by the reference numeral 20 and defines the outer boundaries of the flow path. Like the embodiment of FIGS. 6 and 7, the tailpipe 16 includes a diffuser which is herein referred to by the reference numeral 70. The diffuser 70, however, is simply a smooth walled conical diffuser. The tailpipe 16 extends downstream of the outlet plane 72 of the diffuser 70 as a cylinder. Disposed within the diffuser 70 is a convoluted, annular, thin-walled member 74. The construction of the member 74 is similar to the construction of the wall of the diffuser 18 of FIGS. 1-3. It is supported and spaced from the wall 76 by standoffs 78. The upstream end portion 79 of the member 74 is a cylinder; and the troughs and lobes initiate at zero depth and height, respectively, at approximately the plane 81 of the inlet of the diffuser 70. The peaks 80 of the lobes in the outer surface of the member 74, and thus the floors 82 of the troughs on the inner surface of the member 74, are preferably parallel to and closely spaced from the internal wall surface 84 of the conical diffuser. The peaks 86 of the lobes on the internal surface of the member 74 and the floors of the troughs 88 in the outer surface of the member 74 are parallel to the central flow axis 22.

The member 74 generates a plurality of large scale axial, adjacent, counterrotating vortices downstream of the trough outlet plane 90 of the member 74, which is spaced upstream of the outlet plane 72 of the diffuser portion 70. The vortices scrub the diffuser wall between the planes 90 and 72, thereby energizing the boundary layer. If the diffuser 70 is constructed such that two-dimensional boundary layer separation does not occur upstream of the plane 90, then the vortices may be able to prevent or delay two-dimensional streamwise boundary layer separation which might otherwise occur downstream of the plane 90. The convoluted member 74 therefore permits a more rapid, low-loss, flow expansion than is possible with an "unassisted" conical diffuser or the like.

In the embodiment shown in FIGS. 10 and 11, the wall 98 is a tubular member having a constant circular cross-sectional flow area to its outlet end 99. Other tubular cross-sectional shapes could also be used. Disposed within the end of the tailpipe and extending across substantially the full width (i.e., diameter) of the cross-sectional flow area are a pair of spaced-apart vortex generating convoluted plates 100, 102. Each plate is similar to the plate 10 shown in FIGS. 4 and 5. In this embodiment the downstream edges 104, 106 of the convoluted plates are in the plane of the tailpipe outlet end 99; however, the plates may be disposed further upstream and have their downstream edges spaced a short distance upstream of the outlet end 99. It is believed that the distance of the downstream edges 104, 106 from the outlet end 99 should be no more than about 3 times the maximum trough depth. The large scale axial vortices generated by the convoluted plates rapidly mix the exhaust gases with ambient air, thereby more rapidly reducing the average axial velocity of the exhaust gases once they leave the tailpipe. This should reduce tailpipe noise when compared to the noise of a conventional cylindrical tailpipe without such convoluted plates. It is believed that the slope A of the troughs should be between about 15° and 45°, and that the maximum depth of the troughs, which is the depth measured at their downstream edges, should be at least 10% but no more than 90% of the tailpipe outlet diameter. It should be recognized, however, that for some applications a slope A as small as 5° may produce significant benefits.

As shown in FIG. 11, the plates 100, 102 are disposed, with respect to each other, such that they form a "reflective" wave pattern at their downstream edges. As shown in FIG. 12, they could also be constructed and disposed such that their wave patterns are aligned with each other. It is believed that the aligned pattern will produce the best results since the vortices generated by the plates are more likely to reinforce each other. Although in this preferred embodiment a pair of plates are used to generate the vortices, a single convoluted plate could also be used, as shown in FIG. 13; and the troughs need not have the same maximum depth. It would also be within the scope of this embodiment to have the wall 98 form a diffusing flow path over the axial length of the plates 100, 102. Preferably, the diffuser would have a low diffusion half angle to avoid flow separation and its associated losses.

In the embodiment shown in FIGS. 14 and 15, the tailpipe 16 includes an annular shroud 110 which surrounds and is spaced from the convoluted end portion 112 of the tailpipe. The end portion 112 combines with the shroud 110 to form the noise reducer generally designated by the reference numeral 113. The end portion 112 has external and internal troughs 120, 122, respectively, and external and internal lobes 120A, 122A, respectively. In this embodiment, the internal lobes 122A slope toward the center line 22, and the internal troughs 122 slope away from the center line 22. The object here is to minimize and preferably eliminate diffusion of flow within the end portion 112 to avoid stall and at the same time generate strong vortices downstream of the outlet plane 124. It is more important to maximize the performance of the internal lobes and troughs of the end portion 112 than the external lobes and troughs. Thus, it is preferred to have as large a portion of the opposed sidewalls of each internal trough 122 parallel to each other or closely parallel to each other at the trough outlets.

The shroud 110 is coaxial with the end portion 112 and is spaced therefrom by a plurality of standoffs 114 to define an annulus 116 surrounding the end portion 112. The shroud has an annular inlet 118 which is approximately axially aligned with the inlets to the outer and inner troughs 120, 122, respectively, such that the full length of the troughs is surrounded by the shroud. The troughs 120, 122 blend smoothly at their upstream ends with the cylindrical tailpipe wall surface 20. The shroud 110 extends downstream beyond the diffuser outlet plane 124 to define a constant cross-section cylindrical mixing region 126. The shroud is formed into a diffuser 128 at the downstream end of the mixing region 126 and has an outlet 130.

The shroud 110 and end portion 112 form an ejector. The primary fluid for the ejector is the exhaust system gases exiting from the primary flow passage, the end portion 112 of the tailpipe. The secondary fluid is ambient air passing through the annulus 116, which is the ejector secondary flow passage. The cross-sectional area of the mixing region 126 perpendicular to the principal flow direction should be at least as large and is preferably the same as the sum of the areas of the primary and secondary flow passage outlets in the plane 124. The end portion 112 maintains a substantially constant cross-sectional flow area over its full axial length.

As discussed above with respect to the embodiment of FIG. 2, the convolutions in the inner and outer surfaces of the end portion 112 generate a plurality of large scale, axial vortices. However, in this embodiment the relatively high energy of the primary fluid or exhaust stream is transferred to the low energy secondary fluid airstream through viscous mixing, causing the secondary fluid to be drawn into the mixing region 126. Mixing of the exhaust gases with ambient air is therefore more rapid than in the embodiment of FIG. 2; and the average exhaust gas axial velocity is more rapidly reduced.

The diffuser 128 at the downstream end of the shroud provides even further improved ejector performance. The axial vortices scrub the wall of the mixing region 126 to eliminate or at least add energy to the low momentum boundary layer normally formed along the walls. By displacing the low momentum secondary flow near the wall with higher momentum primary flow, it is believed these vortices create a velocity distribution across the mixing region more favorable to diffusion within the diffuser 128. Thus, the fluid along the walls of the mixing region is able to stay attached to the wall of the diffuser 128 at greater diffusion angles and/or for greater distances than would otherwise be possible. The diffuser creates a lower pressure within the shroud downstream of the mixing region, with the net effect being to cause larger amounts of secondary fluid to be pumped into the mixing region.

The mixing region axial length should be long enough to assure ejector pumping takes place. In the case where there is a diffuser at the downstream end of the mixing region, the ratio of the length L of the mixing region to the inlet diameter D of the diffuser is preferably between 0.5 and 3.0, and is most preferably between 1.0 and 2.0. If the secondary flow passage annulus 116 has a radial dimension R in the plane of the trough inlets, the distance H of the external lobes from the internal shroud surface 134 in the trough outlet plane 124 is preferably between zero and 0.5R.

If the external surface of the cylindrical portion of the tailpipe immediately upstream of the end portion 112 is 2.0 inches in diameter, it is believed that the shroud internal diameter should be about 4.0 inches such that the dimension R is about 1.0 inch The length of the convoluted end portion 112 should be about 2.75 inches and the length L of the mixing region 126 from the plane 124 to the plane of the inlet to the diffuser 128 should be about 4.0 inches. The dimension H should be 0.1 inch and the outlet-to-inlet area ratio of the convoluted end portion 112 should be about 1.0. The troughs 122 are eight in number. The side walls of each trough 122 should be parallel and spaced apart about 0.3925 inch at the trough outlet. The half angle of the conical diffuser 128 is preferably about 25°, and the outlet-to-inlet cross-sectional flow area of the conical diffuser 128 is preferably about 2.5. While a diffuser at the end of the mixing region 126 is preferred, it is not required. It is believed that significant noise reduction will be achieved without such a diffuser.

Fluid dynamic pumps or ejectors similar in design to the ejector described herein with respect to FIGS. 14 and 15 are described and claimed in commonly owned U.S. patent application Ser. No. 857,908, filed Apr. 30, 1986, entitled "Fluid Dynamic Pump", by W. M. Presz, Jr., R. W. Paterson, and M. J. Werle.

Although this invention has been shown and described with respect to detailed embodiments thereof, it will be understood by those skilled in the art that various changes in form and detail thereof may be made without departing from the spirit and scope of the claimed invention.

We claim:

1. An automotive exhaust system tailpipe having a central flow axis and an outlet end for exhausting products of combustion to atmosphere comprising wall means for generating a plurality of pairs of adjacent large scale vortices rotating in opposite directions about respective axes extending downstream in the directions of said flow axis at said outlet end, said wall means comprising an internal surface which defines a flow path along which exhaust products are adapted to flow, said surface including a plurality of adjoining, alternating, U-shaped lobes and troughs extending downstream in the direction of the flow axis, each of said troughs having an inlet end and an outlet end, said trough outlet ends being upstream of said tailpipe outlet end, wherein trough depth increases gradually in said downstream direction, wherein the cross-sectional flow area of said tailpipe increases gradually from said trough inlet ends to said trough outlet ends to reduce the velocity of the exhaust products from a first velocity within said tailpipe at said trough inlets to a second velocity at said trough outlets, and at said trough outlet ends said tailpipe internal surface extends substantially radially outwardly away from said flow axis to create a substantially stepwise increase in cross-sectional flow area at said trough outlet ends.

2. The tailpipe according to claim 1 wherein said troughs and lobes form a continuous convoluted surface about said flow axis.

3. A land based vehicle including an automotive internal combustion engine and an exhaust system connected to said engine, said exhaust system including a muffler and a tailpipe downstream of and in flow communication with said muffler for carrying exhaust gases in a downstream direction, said tailpipe having a central flow axis and including wall means having an internal flow path defining surface including a plurality of adjoining, alternating, U-shaped lobes and troughs disposed circumferentially about said flow axis and extending in said downstream direction for generating adjacent pairs of counterrotating axial vortices ,each of said troughs having an inlet and an outlet, wherein trough depth increases gradually in said downstream direction from zero at said trough inlet to a maximum at said trough outlet, and said tailpipe wall means extends downstream beyond said trough outlets, and at said trough outlets said tailpipe internal surface extends substantially radially outwardly away from said flow axis to create a substantially stepwise increase in cross-sectional flow area at said trough outlets.

4. The vehicle according to claim 3, wherein the cross-sectional flow area of said tailpipe increases gradually from said trough inlets to said trough outlets for the purpose of reducing the velocity of the exhaust gases from a first velocity within said tailpipe at said trough inlets to a second velocity at said trough outlets.

5. The vehicle according to claim 3, wherein said troughs and lobes form a continuous convoluted surface about the flow axis.

6. An exhaust system for an automotive application, comprising a muffler, a tailpipe downstream of and in flow communication with said muffler, and a thin-walled member disposed within said tailpipe, said tailpipe having an outlet end and an internal surface defining an exhaust gas flow path having a central flow axis, said thin-walled member having oppositely facing downstream extending surfaces spaced from said internal surface and over which exhaust gases are adapted to flow, said member including an exposed upstream edge and an exposed downstream edge such that fluid flowing over said oppositely facing surfaces of said member can mix at said downstream edge, said member having a convoluted portion comprising a plurality of adjoining, alternating, lobes and troughs, said lobes and troughs increasing gradually in height and depth, respectively, in the downstream direction and terminating at said downstream edge which is wave shaped, each of said lobes and troughs being smoothly U-shaped along said lobe and trough length in cross section perpendicular to the downstream direction and blending smoothly with each other to define a smoothly undulating surface adapted to generate pairs of adjacent counterrotating axial vortices, wherein said downstream edge is at or upstream of said tailpipe outlet end.

7. The automotive exhaust system according to claim 6, wherein said internal surface defines a conical diffuser having a circular inlet of first cross-sectional flow area and a circular outlet having a cross-sectional flow area larger than said first area, wherein said thin-walled member is annular, closely spaced from said conical diffuser surface from said upstream edge to said downstream edge of said member, and coaxial with said diffuser.

8. The automotive exhaust system according to claim 7, wherein said internal surface extends downstream of said diffuser outlet defining a cylindrical mixing region immediately downstream of said diffuser outlet.

9. A land based vehicle including an automotive internal combustion engine and an exhaust system connected to said engine, the exhaust system including a muffler and a tailpipe downstream of and in flow communication with said muffler, said tailpipe having a central flow axis and wall means having internal and external surfaces which define a convoluted tailpipe end portion for generating a plurality of pairs of adjacent, counterrotating axial vortices, said end portion comprising a plurality of adjoining, alternating, U-shaped lobes and troughs disposed circumferentially about said flow axis in both said internal and external surfaces, said lobes and troughs extending downstream in the direction of said flow axis and increasing, respectively, in height and depth in said downstream direction, said lobes and troughs forming a wave-shaped tailpipe outlet edge exposed to atmosphere, said tailpipe including an annular shroud coaxial with the flow axis and surrounding said wall means over the length of said troughs and lobes and closely spaced therefrom defining an annular secondary flow passage therebetween for receiving ambient air, wherein said shroud extends downstream beyond said exposed outlet edge defining a circumferentially enclosed mixing region and forming an ejector, whereby during operation streams of exhaust gases from said internal surface troughs are interleaved with and mixed in said mixing region with streams of ambient air from said external surface troughs.

10. The vehicle according to claim 9, wherein said convoluted end portion has a substantially constant cross-sectional flow area over the length of said convoluted end portion.

11. The vehicle according to claim 10, wherein said shroud includes a conical diffuser adjoining and downstream of said mixing region.

12. An automotive exhaust system tailpipe assembly for carrying exhaust products in a downstream direction, said assembly comprising a substantially tubular tailpipe and a thin-walled member disposed entirely within said tailpipe, said tailpipe having a central flow axis, an internal surface defining an exhaust gas flow path, and an outlet end open to atmosphere, said thin-walled member having oppositely facing downstream extending surfaces spaced from said internal surface and over which exhaust products are adapted to flow, said member including an exposed upstream edge and an exposed downstream edge within said tailpipe, said member having a convoluted portion comprising a plurality of vortex generating, adjoining, alternating, U-shaped lobes and troughs, said lobes and troughs extending downstream and terminating at said downstream edge, wherein said trough depth increases gradually in a downstream direction to a maximum depth at said downstream edge.

13. The tailpipe assembly according to claim 12 wherein said troughs and lobes initiate downstream of said thin-walled member upstream edge.

14. The tailpipe assembly according to claim 12 wherein each one of said troughs is smoothly U-shaped along said trough length in cross section perpendicular to the downstream direction and blends smoothly with each of said lobes adjacent said trough to define a smoothly undulating surface which is wave-shaped in cross section perpendicular to the downstream direction.

15. The tailpipe assembly according to claim 12 wherein said internal surface has a substantially circular cross-sectional flow area over that portion of said internal surface length which surrounds said thin-walled member, and said thin-walled member is a convoluted plate extending across said tailpipe.

16. The tailpipe assembly according to claim 15 including a pair of said convoluted plates spaced apart from and facing each other.

17. The tailpipe assembly according to claim 14 wherein said internal surface defines a conical diffuser having a circular inlet of first cross-sectional flow area and a circular outlet having a second cross-sectional flow area larger than said first cross-sectional flow area, wherein said vortex generating thin-walled member is annular and coaxial with said diffuser, and said convoluted portion extends entirely around said central flow axis.

18. The tailpipe assembly according to claim 17 wherein said troughs initiate in said thin-walled member substantially at said diffuser inlet.

19. The tailpipe assembly according to claim 17 wherein one of said member is downstream extending surfaces faces radially outwardly, and the peaks of the lobes of said one surface are substantially parallel to and closely spaced from said internal surface of said conical diffuser.

20. The tailpipe assembly according to claim 19 wherein each of said troughs has a floor, and said floors of said troughs of said one surface are substantially parallel to the axis of said conical diffuser.

21. The tailpipe assembly according to claim 19 wherein said downstream edge of said convoluted wall member is wave-shaped, and said troughs increase in depth to said downstream edge, said downstream edge being spaced upstream of said diffuser outlet.

22. An automotive exhaust system tailpipe assembly for carrying exhaust gases in a downstream direction, said assembly including a substantially tubular tailpipe having a central flow axis, an outlet end, and wall means, said wall means comprising an internal surface along which the exhaust gases are adapted to flow, said surface including a plurality of adjoining, alternating, U-shaped lobes and troughs extending lengthwise in the downstream direction to said tailpipe outlet end for generating a plurality of pairs of adjacent large scale vortices rotating in opposite directions about respective axes extending in the downstream direction, each of said troughs having an inlet end and an outlet end, wherein trough depth increases gradually in the downstream direction and wherein said wall means has a surface which is an external surface of said tailpipe exposed to atmosphere, said lobes in said internal surface defining corresponding troughs in said external surface, and said troughs in said internal surface defining lobes in said external surface, said tailpipe assembly including an annular shroud coaxial with the flow axis and surrounding said tailpipe over the full length of said troughs and lobes and closely spaced therefrom defining an annular secondary flow passage therebetween for receiving ambient air, wherein said shroud extends downstream beyond said tailpipe outlet end defining a circumferentially enclosed mixing region and forming an ejector with said tailpipe, whereby during operation streams of exhaust gases from said internal surface troughs are interleaved with and mix in said mixing region with streams of ambient air from said external surface troughs.

23. The tailpipe assembly according to claim 22 wherein said shroud includes a diffuser adjoining and downstream of said mixing region.

24. The tailpipe assembly according to claim 23 wherein said mixing region is substantially cylindrical and said diffuser is conical.

* * * * *